US009953518B2

(12) United States Patent
Bhat

(10) Patent No.: US 9,953,518 B2
(45) Date of Patent: Apr. 24, 2018

(54) SYSTEMS AND METHODS FOR PREDICTING AND INCREASING THE THREAT LEVEL AT ATM CENTERS PRIOR TO ALARM EVENT DETECTION

(71) Applicant: Honeywell International Inc., Morristown, NJ (US)

(72) Inventor: Pathanjali N. Bhat, Mangalore (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 15/658,574

(22) Filed: Jul. 25, 2017

(65) Prior Publication Data

US 2018/0033292 A1 Feb. 1, 2018

(51) Int. Cl.

| | |
|---|---|
| ***G08B 13/00*** | (2006.01) |
| ***G08B 31/00*** | (2006.01) |
| ***G08B 21/22*** | (2006.01) |

(52) U.S. Cl.

CPC ..... *G08B 31/00* (2013.01); *G08B 21/22* (2013.01)

(58) Field of Classification Search

CPC ..... G08B 31/00; G08B 21/22
USPC ..... 340/540, 541
See application file for complete search history.

(56) References Cited

U.S. PATENT DOCUMENTS 5,321,242 A * 6/1994 Heath, Jr. ..... G07F 9/06 235/375
5,410,295 A * 4/1995 Van Lint ..... G07F 9/02 340/309.16
5,488,660 A * 1/1996 Dawson ..... G07C 9/00015 235/382
5,519,669 A * 5/1996 Ross ..... G01S 15/02 340/541
5,731,575 A * 3/1998 Zingher ..... G06Q 20/341 235/379
7,183,915 B2 2/2007 Bartholf et al.
7,995,791 B2 8/2011 Flook et al.
8,447,273 B1 * 5/2013 Friedlander ..... H04M 1/72577 382/115

(Continued)

FOREIGN PATENT DOCUMENTS

| | | |
|---|---|---|
| CN | 101266704 A | 9/2008 |
| EP | 0 639 822 A1 | 2/1995 |
| EP | 2 503 354 A1 | 9/2012 |

OTHER PUBLICATIONS

English-language translation of abstract for CN patent publication 101266704, dated Sep. 17, 2008.

(Continued)

*Primary Examiner* — Ojiako Nwugo
(74) *Attorney, Agent, or Firm* — Husch Blackwell LLP

(57) ABSTRACT

Systems and methods for predicting and increasing the threat level at ATM centers prior to alarm event detection are provided. Some methods can include receiving a first signal from an ATM machine indicative of whether the ATM machine dispenses cash, receiving a second signal from a people counter indicative of persons entering or exiting a region in which the ATM machine is located, and responsive to the first signal or the second signal, determining whether to increase a threat level associated with the ATM machine irrespective of detecting an alarm event associated with the ATM machine.

20 Claims, 2 Drawing Sheets

(56) References Cited

U.S. PATENT DOCUMENTS

| | | | | |
|---|---|---|---|---|
| 2005/0273442 | A1* | 12/2005 | Bennett | G06Q 20/3674 705/67 |
| 2007/0018818 | A1* | 1/2007 | Andres | G08B 13/1409 340/571 |
| 2007/0150827 | A1 | 6/2007 | Singh et al. | |
| 2008/0075235 | A1* | 3/2008 | Russikoff | G07F 19/20 379/45 |
| 2008/0100704 | A1* | 5/2008 | Venetianer | G06F 17/3079 348/143 |
| 2008/0136657 | A1* | 6/2008 | Clark | G07F 19/20 340/686.6 |
| 2008/0251578 | A1 | 10/2008 | Jansing | |
| 2015/0145706 | A1* | 5/2015 | Arif | G06F 21/31 341/23 |
| 2017/0134514 | A1* | 5/2017 | Greifeneder | H04L 67/22 |

OTHER PUBLICATIONS

Extended European search report for corresponding EP patent application 17183809.7, dated Nov. 29, 2017.
English-language translation of abstract for EP patent publication 2 503 354, dated Sep. 26, 2012.

* cited by examiner

SYSTEMS AND METHODS FOR PREDICTING AND INCREASING THE THREAT LEVEL AT ATM CENTERS PRIOR TO ALARM EVENT DETECTION

FIELD

The present invention relates generally to ATM centers. More particularly, the present invention relates to systems and methods for predicting and increasing the threat level at ATM centers prior to alarm event detection.

BACKGROUND

ATM machines are known in the art and can dispense cash as well as collect checks for a bank. ATM machines are rarely placed in an open location unless they are located in an office or on a campus that has full time security. Instead, in many situations, an ATM machine is placed inside of an enclosure, such as a room of a building. Some of these ATM machines are manually guarded around the clock by security guards on multiple shifts. However, the ATM security market is increasing the use of automated security systems to reduce the costs of such manual security monitoring.

Known automated security systems for ATM machines include a plurality of intrusion alarm sensors installed in, on, at, or around an ATM machine, one or more surveillance cameras monitoring the ATM machine, and a central monitoring station where operators can monitor a plurality of closed circuit television screens displaying video data streams from the surveillance cameras. Alarms can be generated from the intrusion alarm sensors associated with the ATM machine and can be prioritized based on the severity level thereof. For example, panic alarms can be assigned a highest severity level. Operators at the central monitoring station can monitor alarms from ATM machines and, responsive thereto, connect to a particular ATM machine or video surveillance camera monitoring the particular ATM machine to monitor the situation at the ATM machine. When the operator determines that the situation at the ATM machine is an emergency, the operator can summon the police and/or talk with persons at the site of the ATM machine, in real time, via microphones at the ATM site and the central monitoring station, for further assistance or warning.

Although the above-described automated security systems work well, they have several limitations. First, operators at the central monitoring station determine with which ATM machines or video surveillance cameras to connect based on the severity level and priority of the alarms received from the ATM machines. Although the video surveillance cameras can monitor and record events at ATM machines around the clock, in many known systems, only alarms from an ATM machine that have a highest severity level receive operator attention. For example, a sensor detecting the back door or the currency chest of an ATM machine being open or a panic button being pressed can be assigned a highest severity level, and such a severity level can trigger immediate operator attention at a central monitoring station as well as further monitoring activities, such as immediately downloading a video data stream from a video surveillance camera monitoring the ATM machine and communication with the ATM machine directly.

Second, ATM machines that are monitored by automated security systems, as opposed to manually guarding the ATM machine around the clock, are vulnerable to situations in which a user of an ATM machine does not or is not able to press a panic button, particularly in situations while or after the user withdraws money from the ATM machine. For example, after a user withdraws money from an ATM machine, a person with a weapon may threaten the user and take his money. Such an incident can go unnoticed by an automated security system if the user cannot or does not press a panic button associated with the ATM machine in a timely manner. Indeed, if the user is killed, is in a panic state, or is so physically injured that he is not in a position to press a panic button, then an automated security system will not recognize the event as an alarm with a high severity level.

Finally, some ATM machines can be vandalized by cutting the ATM machine, carrying the ATM machine away from its location, or breaking the currency chest of the ATM machine to steal the cash inside. In these situations, a vandal will have likely spent a considerable amount of time in or around the ATM machine before a sensor associated with the ATM machine is triggered. At such time, there could already be a considerable amount of damage to the ATM machine and the setup thereof. Unfortunately, there are no known systems and methods for detecting such events prior to and unless an intrusion alarm sensor is triggered.

In view of the above, there is a continuing, ongoing need for improved systems and methods.

DETAILED DESCRIPTION

Figure 1:
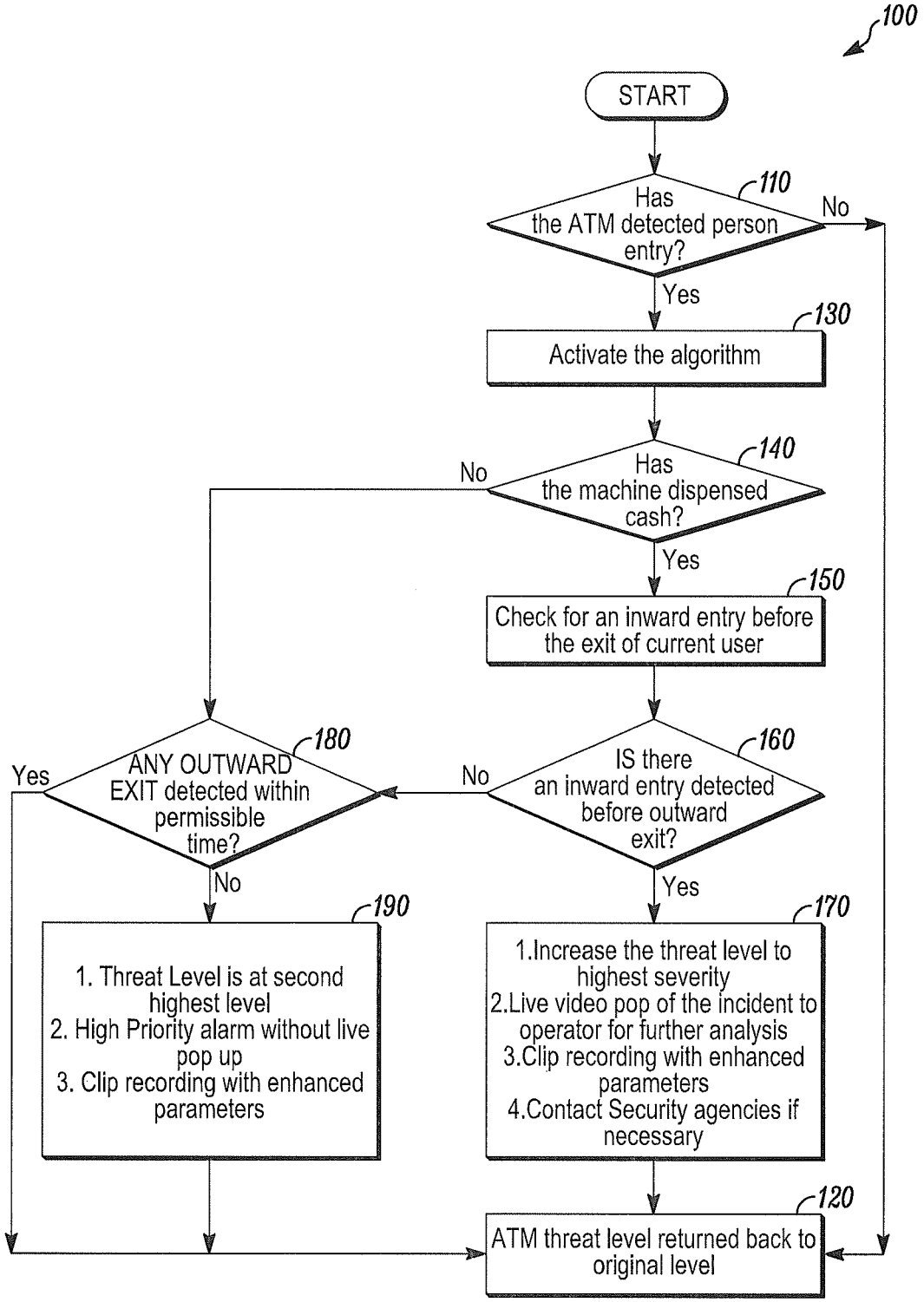
FIG. 1 is a block diagram of a method in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

It is known that most of the incidents that occur in or around ATM machines that require intervention from security personnel occur when money is dispensed from the ATM machine and a user spends time counting the money before leaving the vicinity of the ATM machine, when the ATM machine is in a high crime area, is isolated, or is otherwise located in a place that does not include a minimum amount of human traffic, or during a predetermined period of time of day, for example, from 9 pm until 1 am. As explained above, known systems and methods fail to address such factors that lead to the majority of incidents in or around ATM machines because known systems and methods depend on the detection of specific actions to trigger an alarm, such as opening an ATM door or chest or pressing a panic button.

In view of the above, embodiments disclosed herein can include systems and methods for predicting and increasing the threat level at ATM centers prior to alarm event detection. For example, in an effort to prevent robbery and theft, systems and methods disclosed herein can monitor conditions of and around an ATM machine prior to the detection of any alarm event or condition.

In some embodiments, systems and methods disclosed herein can monitor for and detect when an ATM machine dispenses cash and when, before a user exits a vicinity of the ATM machine, one or more other persons are detected entering the vicinity of the ATM machine. By monitoring one or more of these factors, alone or in combination, systems and methods can predict a high severity threat event before such a corresponding alarm event occurs and can solicit security operator attention therefor.

In accordance with disclosed embodiments, systems and methods disclosed herein can increase the threat level associated with a particular ATM machine during a transaction at the ATM machine, such as when and after the ATM machine dispenses cash, or when, before a user exits a vicinity of an ATM machine, one or more other persons is detected entering the vicinity of the ATM machine. Systems and methods disclosed herein can also increase the threat level associated with a particular ATM machine when a user of the ATM machine is in the vicinity of the ATM machine for more than a predetermined period of time with or without using the ATM machine.

For example, when an ATM machine is located inside of a predetermined region, for example, a room of a building, the room can include a people counter at the door to the room. In some embodiments, the people counter can include a bidirectional infrared sensor on, inside, or associated with the door to the room that can detect when a person enters and exits the room. In some embodiments, a bidirectional infrared sensor can include at least two detectors aligned in parallel with a gap therebetween. A person entering the room can be detected by a first of the detectors that is farthest from the door to the room, and a person exiting the room can be detected by a second of the detectors closest to the door to the room.

In some embodiments, when systems and methods disclosed herein detect a first person entering the room in which the ATM machine is located, subsequently detect the ATM machine dispensing cash, and subsequently detect a second person entering the room in which the ATM machine is located prior to detecting the first person exiting the room in which the ATM machine is located, that is, when systems and methods disclosed herein determine that the ATM machine dispenses cash before one of the first or second persons exit the room and therefore, that there are two people in the room, systems and methods disclosed herein can increase the threat level associated with the ATM machine to a maximum severity threat level with top priority and solicit immediate security operator attention. When systems and methods identify a maximum severity threat level, systems and methods can automatically display or push a video data stream from a video surveillance camera monitoring the ATM machine to an operator at a central monitoring station and/or directly connect the operator to the ATM machine or systems associated therewith.

Additionally or alternatively, in some embodiments, when systems and methods disclosed herein detect a person entering the room in which the ATM machine is located and fail to detect the person exiting the room in which the ATM machine is located within a predetermined period of time, irrespective of whether the ATM machine dispenses cash, systems and methods disclosed herein can increase the threat level associated with the ATM machine to a high severity threat level and solicit security operator attention. When systems and methods disclosed herein identify a high severity threat level, systems and methods can notify an operator at a central monitoring station about the high severity threat level, responsive to which the operator can access a video data stream from a video surveillance camera monitoring the ATM machine and/or directly connect to the ATM machine or systems associated therewith.

Additionally or alternatively, in some embodiments, when systems and methods disclosed herein detect a single person entering the room in which the ATM machine is located and subsequently detect the ATM machine dispensing cash, systems and methods disclosed herein can increase the threat level associated with the ATM machine to the high severity threat level and notify an operator at a central monitoring station about the high severity threat level when systems and methods disclosed herein do not detect the person exiting the room within a predetermined period of time after the ATM machine dispenses cash. Conversely, when systems and methods disclosed herein detect a single person entering the room in which the ATM machine located, subsequently detect the ATM machine dispensing cash, and subsequently detect the single user exiting the room in which the ATM machine is located within a predetermined period of time after the ATM dispenses cash, systems and methods disclosed herein can reduce the threat level associated with the ATM machine to an original threat level.

Additionally or alternatively, in some embodiments, systems and methods disclosed herein can increase or maintain the threat level associated with the ATM machine to the maximum severity threat level during a predetermined period of time of day, for example, from 9 pm to 1 am.

In some embodiments, systems and methods disclosed herein can be activated or triggered responsive to a user entering a vicinity, for example, a room, of an ATM machine, responsive to a user entering a card into an ATM machine, or responsive to an ATM machine dispensing cash to a user. Similarly, in some embodiments, systems and methods disclosed herein can be deactivated responsive to the user exiting the vicinity of the ATM machine. For example, a people counter can detect a person entering or exiting a room in which the ATM machine is located, and a sensor associated with the ATM machine can detect when the ATM machine dispenses cash.

FIG. 1 is a block diagram of a method 100 in accordance with disclosed embodiments. As seen in FIG. 1, the method 100 can include determining whether a first person entering a vicinity of an ATM machine has been detected as in 110. If not, then the method 100 can include maintaining the threat level associated with the ATM machine at an original level as in 120. However, if the method 100 detects a first person entering the vicinity of the ATM machine as in 110, then the method can include activating an algorithm in accordance with disclosed embodiments as in 130.

For example, the method 100 can include determining whether the ATM machine has dispensed cash as 140. If so, then the method 100 can include determining whether a second person entering the vicinity of the ATM machine has been detected before the first person exiting the vicinity of the ATM machine has been detected as in 150 and 160. If the method 100 determines that such a second inward entry has been detected prior to such a first outward entry being detected as in 160, then the method 100 can include increasing a threat level associated with the ATM machine to a maximum severity threat level, automatically displaying or pushing a video data stream from a video surveillance camera monitoring the ATM machine to an operator at a central monitoring station for further analysis, recording such a video data stream with enhanced parameters, and/or contacting one or more security agencies as in 170. Then, the method 100 can include returning the threat level associated with the ATM machine to its original level as in 120.

If the method 100 determines that the ATM machine has not dispensed cash as in 140, then the method 100 can include determining whether the first person exiting the vicinity of the ATM machine has been detected within a predetermined period of time of detecting the first person entering the vicinity of the ATM machine as in 180. If so, then the method can include maintaining the threat level associated with the ATM machine at an original level as in 120. However, if the method 100 determines that the first person exiting the vicinity of the ATM machine has not been detected within the predetermined period of time of detecting the first person entering the vicinity of the ATM machine as in 180, then the method 100 can include increasing a threat level associated with the ATM machine to a second highest severity threat level, notifying an operator at a central monitoring station about the increased severity threat level, and/or recording a video data stream from a video surveillance camera monitoring the ATM machine with enhanced parameters as in 190. Then, the method 100 can include returning the threat level associated with the ATM machine to its original level as in 120.

If the method 100 determines that a second inward entry has not been detected prior to a first outward entry being detected as in 160, then the method 100 can include determining whether the detected first outward entry was detected within a predetermined period of time of the inward entry detected in 110 as in 180. Then, the method 100 can proceed as described above.

Figure 2:
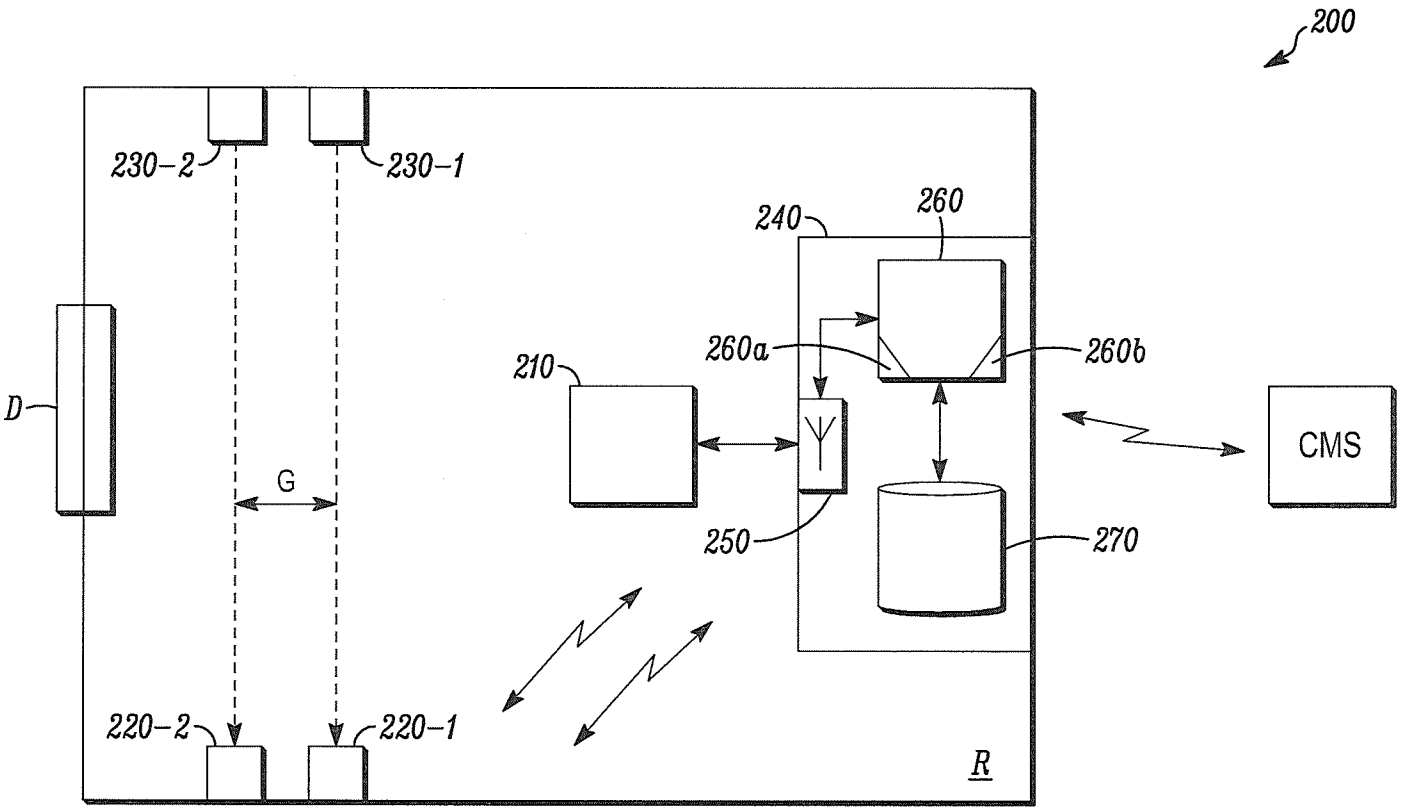
FIG. 2 is a block diagram of a system in accordance with disclosed embodiments.

FIG. 2 is a block diagram of a system 200 in accordance with disclosed embodiments. As seen in FIG. 2, the system 200 can include an ATM machine 210 located within a region R and at least first and second infrared detectors 220-1, 220-2 aligned in parallel with a gap G therebetween. Each of the detectors 220-1, 220-2 can receive a respective infrared signal emitted from a respective infrared emitter 230-1, 230-2. In some embodiments, each of the detectors 220-1, 220-2 can be associated with a door D to the region R such that a first of the detectors 220-1 located farthest from the door D detects inward entry through door D into the region R and a second of the detectors 220-2 located closest to the door D detects outward entry through the door out of the region R. In some embodiments, each of the detectors 220-1, 220-2 can detect inward or outward entry when the detector 220-1, 220-2 fails to receive a respective infrared signal from the respective infrared emitter 230-1, 230-2 for a predetermined period of time, for example, when a person crosses the space between a respective emitter 230-1, 230-2 and detector 220-1, 220-2, thereby blocking the detector 220-1, 220-2 from receiving the signal.

Each of the ATM machine 210 and the detectors 220-1, 220-2 can transmit signals to a local or remote monitoring station 240. For example, in some embodiments, the monitoring station 240 can be locally associated with the ATM machine 210 and communicate with a central monitoring station, and in some embodiments, the monitoring station 240 can be located at the central monitoring station. As seen in FIG. 2, communication between the ATM machine 210, the detectors 220-1, 220-2, the monitoring station 240, and the central monitoring station can be wired, wireless, or a combination thereof.

The monitoring station 240 can receive the signals from the ATM machine 210 and the detectors 220-1, 220-2 via a transceiver device 250, which can be in communication with control circuitry 260, one or more programmable processors 260*a*, and executable control software 260*b* as would be understood by one of ordinary skill in the art. The executable control software 260*b* can be stored on a transitory or non-transitory computer readable medium, including, but not limited to local computer memory, RAM, optical storage media, magnetic storage media, flash memory, and the like.

In some embodiments, the control circuitry 260, programmable processor 260*a*, and control software 260*b* can execute and control at least some of the methods described above and herein. For example, the control circuitry 260, programmable processor 260*a*, and control software 260*b* can evaluate the signals received from the ATM machine 210 and the detectors 220-1, 220-2, via the transceiver device 250, to determine whether to increase a threat level associated with the ATM machine 210 and if so, to which level. In some embodiments, the monitoring station 240 can include a memory device 270 in communication with the control circuitry 260, programmable processor 260*a*, and control software 260*b* that can include a database device for storing a current or original threat level associated with the ATM machine 210 as well as times of ATM activity reported by the ATM machine 210 and inward and outward entry detections reported by the detectors 220-1, 220-2.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

receiving a first signal from an ATM machine indicative of whether the ATM machine dispenses cash;

receiving a second signal from a people counter indicative of persons entering or exiting a region in which the ATM machine is located; and responsive to the first signal or the second signal, determining whether to increase a threat level associated with the ATM machine irrespective of detecting an alarm event associated with the ATM machine.

2. The method of claim 1 further comprising increasing the threat level associated with the ATM machine when the first signal from the ATM machine indicates that the ATM machine dispensed cash and the second signal from the people counter indicates that more than one person is in the region in which the ATM machine is located.

3. The method of claim 2 further comprising:

increasing the threat level to a maximum severity threat level; and soliciting immediate operator attention to the ATM machine.

4. The method of claim 1 further comprising increasing the threat level associated with the ATM machine when the first signal from the ATM machine indicates that the ATM machine dispensed cash and the second signal from the people counter indicates that a single person is located in the region in which the ATM machine is located for a predetermined period of time after the ATM machine dispensed cash.

5. The method of claim 4 further comprising:

increasing the threat level to a high severity threat level; and notifying an operator about the high severity threat level associated with the ATM machine.

6. The method of claim 1 further comprising increasing the threat level associated with the ATM machine when the second signal from the people counter indicates that a person is in the region in which the ATM machine is located for a predetermined period of time.

7. The method of claim 6 further comprising:

increasing the threat level to a high severity threat level; and notifying an operator about the high severity threat level associated with the ATM machine.

8. The method of claim 6 further comprising increasing the threat level irrespective of the first signal from the ATM machine.

9. The method of claim 1 further comprising maintaining the threat level associated with the ATM machine at a current threat level when the second signal from the people counter indicates that a single person exits the region in which the ATM machine is located within a predetermined period of time of the single person entering the region in which the ATM machine is located or within the predetermined period of time from when the first signal from the ATM machine indicates the ATM dispensed cash.

10. A system comprising:

a people counter in a region in which an ATM machine is located;

a transceiver device;

a programmable processor; and executable control software stored on a non-transitory computer readable medium, wherein the transceiver device receives a first signal from the people counter indicative of persons entering or exiting the region, and wherein, responsive to the first signal, the programmable processor and the executable control software determine whether to increase a threat level associated with the ATM machine irrespective of detecting an alarm event associated with the ATM machine.

11. The system of claim 10 wherein the programmable processor and the executable control software increase the threat level associated with the ATM machine when the first signal from the people counter indicates that a person is in the region for a predetermined period of time.

12. The system of claim 11 wherein the programmable processor and the executable control software increase the threat level to a high severity threat level and cause a notification signal to be transmitted to an operator indicative of the high severity threat level associated with the ATM machine.

13. The system of claim 11 wherein the programmable processor and the executable control software increase the threat level irrespective of whether the ATM machine has dispensed cash.

14. The system of claim 10 further comprising the ATM machine, wherein the transceiver device receives a second signal from the ATM machine indicative of whether the ATM dispenses cash, and wherein, responsive to the first signal and the second signal, the programmable processor and the executable control software determine whether to increase the threat level associated with the ATM machine.

15. The system of claim 14 wherein the programmable processor and the executable control software increase the threat level associated with the ATM machine when the first signal from the people counter indicates that more than one person is in the region and the second signal from the ATM machine indicates that the ATM machine dispensed cash.

16. The system of claim 15 wherein the programmable processor and the executable control software increase the threat level to a maximum severity threat level and cause a solicitation signal to be emitted to solicit immediate operator attention to the ATM machine.

17. The system of claim 14 wherein the programmable processor and the executable control software increase the threat level associated with the ATM machine when the first signal from the people counter indicates that a single person is located in the region of the ATM machine for a predetermined period of time after the second signal indicates the ATM machine dispensed cash.

18. The system of claim 17 wherein the programmable processor and the executable control software increase the threat level to a high severity threat level and cause a notification signal to be transmitted to an operator indicative of the high severity threat level associated with the ATM machine.

19. The system of claim 14 wherein the programmable processor and the executable control software maintain the threat level associated with the ATM machine at a current level when the first signal from the people counter indicates that a single person exits the region in which the ATM machine is located within a predetermined period of time of the single person entering the region in which the ATM machine is located or within the predetermined period of time from when the first signal from the ATM machine indicates the ATM dispensed cash.

20. The system of claim 10 wherein the people counter includes first and second bidirectional infrared sensors monitoring a door to the region, wherein the first bidirectional infrared sensor detects a person entering the region, and wherein the second bidirectional infrared sensor detects the person exiting the region.

* * * * *